United States Patent [19]

Matsuzaki

[11] Patent Number: 4,902,149

[45] Date of Patent: Feb. 20, 1990

[54] PRINTER FOR PRINTING A PARTICULAR CHARACTER AT A DESIRED POSITION

[75] Inventor: Hideo Matsuzaki, Tokyo, Japan

[73] Assignee: Canon Kabushiki Kaisha, Tokyo, Japan

[21] Appl. No.: 208,782

[22] Filed: Jun. 17, 1988

Related U.S. Application Data

[63] Continuation of Ser. No. 894,742, Aug. 11, 1986, abandoned, which is a continuation of Ser. No. 623,338, Jun. 22, 1984, abandoned.

[30] Foreign Application Priority Data

Jun. 29, 1983 [JP] Japan ..... 58-116111

[51] Int. Cl.[4] ..... B41J 19/50

[52] U.S. Cl. ..... 400/279; 400/285.4

[56] References Cited

U.S. PATENT DOCUMENTS

| | | | |
|---|---|---|---|
| 3,924,723 | 12/1975 | Cooper et al. | 400/63 |
| 3,968,868 | 7/1976 | Greek, Jr. et al. | 400/63 |
| 4,403,301 | 9/1983 | Fessel | 400/63 |
| 4,457,638 | 7/1984 | Horn et al. | 400/279 |

FOREIGN PATENT DOCUMENTS

| | | | |
|---|---|---|---|
| 11288 | 2/1981 | Japan | 400/285 |
| 51175 | 3/1983 | Japan | 400/285.4 |
| 2087115 | 5/1982 | United Kingdom | 400/279 |

OTHER PUBLICATIONS

Kolpek, "Text Formatting" IBM Technical Disclosure Bulletin, vol. 16, No. 2, pp. 391–394, 7/73.

Adam et al, "Line . . . Alignment", IBM Technical Disclosure Bulletin, vol. 25, No. 1, pp. 213–215.

McInroy et al, "Monetary & Numeric Formatting", IBM Technical Disclosure Bulletin, vol. 25, No. 11A, pp. 5606–5608, 4/83.

Garcia et al, "Method . . . Printer", IBM Technical Disclosure Bulletin, vol. 22, No. 5, p. 1753, 10/79.

*Primary Examiner*—William Pieprz

*Attorney, Agent, or Firm*—Fitzpatrick, Cella, Harper & Scinto

[57] ABSTRACT

A printer comprises input keys for instructing predetermined characters and input keys for instructing the particular positions, wherein the instructed characters are printed in the particular positions.

11 Claims, 6 Drawing Sheets

PRINTER FOR PRINTING A PARTICULAR CHARACTER AT A DESIRED POSITION

This application is a continuation of application Ser. No. 894,742 filed Aug. 11, 1986, now abandoned, which in turn is a continuation of application Ser. No. 623,338, filed June 22, 1984, now abandoned.

BACKGROUND OF THE INVENTION

1. Field of the Invention

The present invention relates to a printer which can print particular characters in the positions designated.

2. Description of the Prior Art

In conventionally known printers, a tabulation function to align the print start positions is provided so that the print start positions may be easily designated.

However, to print the particular characters in desired positions, it is necessary to confirm the length of the character string and the positions of the particular characters and to key them in.

SUMMARY OF THE INVENTION

It is an object of the present invention to provide a printer which can print characters or the like designated in the positions designated in consideration of the above-mentioned point.

It is a specific object of the invention to provide a printer in which particular characters are printed in the position designated without considering the length of character string and the positions of the particular characters.

To accomplish the above objects, a printer according to the invention comprises first input means for instructing predetermined characters and second input means for instructing the particular positions, whereby the characters instructed by the first input means in the particular positions are printed.

DETAILED DESCRIPTION OF THE PREFERRED EMBODIMENT

The present invention will now be described in detail hereinbelow with reference to the drawings.

Figure 1:
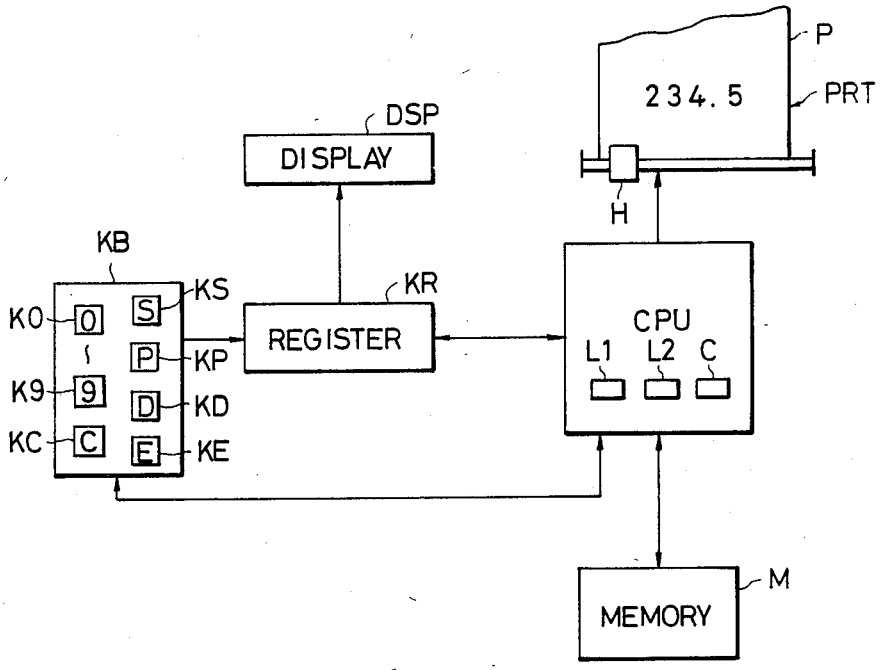
FIG. 1 is a block diagram showing one embodiment of the present invention.

FIG. 1 is a block diagram showing one embodiment of the invention, in which a keyboard KB is provided with: numeric value keys K0 to K9; arbitrary character key group KC; a control key KS to designate the particular characters; a control key KP to designate the particular positions; an instruction key KD to instruct the start of inputting of a character string; an instruction key KE for allowing the particular characters to be printed in accordance with the positions designated; and other control keys (not shown).

KR denotes a register to store key information from the keyboard KB; DSP is a numeric value display; and CPU is a central processing unit.

A printer PRT moves from left to right relative to print paper P and performs printing using a serial print head H. Also, a memory M stores information from the CPU.

Figure 2:
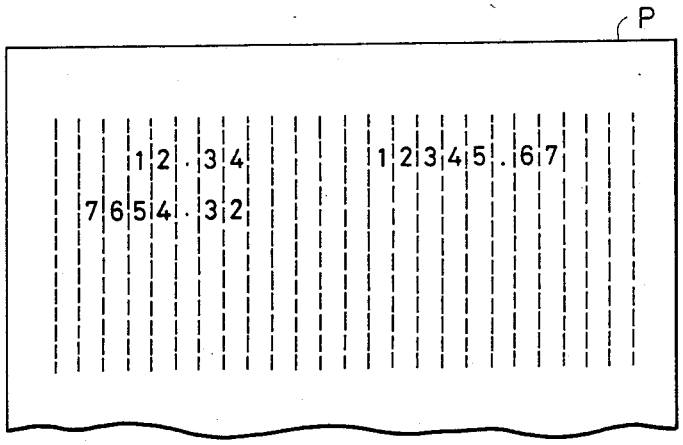
FIG. 2 is an explanatory diagram showing an example of printing according to the present embodiment.
Figure 3:
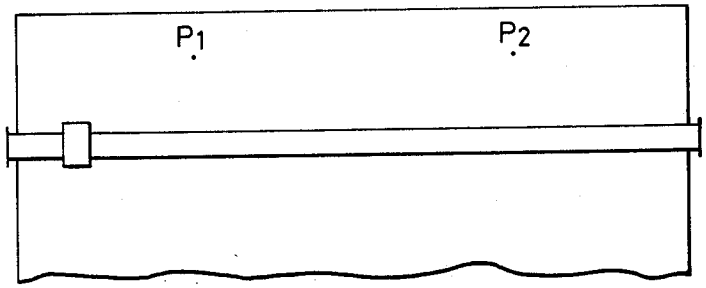
FIG. 3 is an explanatory diagram showing the positions designated in the example of printing shown in FIG. 2.

FIG. 2 shows an example of printing according to this embodiment. As shown in FIG. 3, the positions which are designated are specified P1 and P2 and it is assumed that the character of decimal point "." is designated. A method of designating the print positions and a method of designating the print characters in the above-mentioned particular positions will be explained in accordance with FIGS. 3 and 4.

Firstly, the print head H is moved to the first desired position P1 (step S2) and the position designation control key KP is depressed (step S4). Thus, the CPU stores the position P1 into the memory M (step S6) in accordance with this operation.

Subsequently, the print head H is moved to the position P2 (step S8) and the position designation control key KP is depressed (step S10), then the position P2 is stored into the memory M (step S12) similarly to the storage of the position P1.

Next, by depressing the particular character instruction key KS and the decimal point key "." in the character key group (steps S14 and S16), the decimal point "." is stored as the particular character information into a latch L1 (step S18).

Due to the above operations, the designated positions P1 and P2 are stored into the memory M and the particular position print character information "." is stored into the latch L1.

Figure 5:
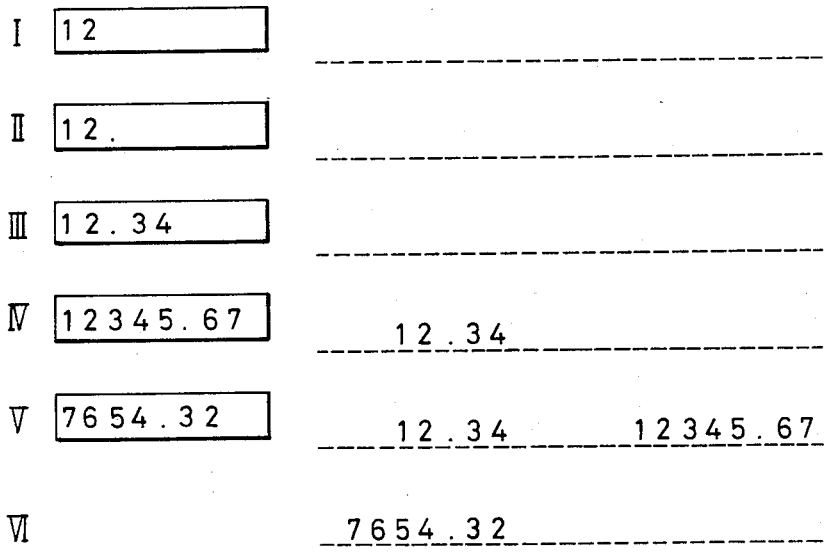
FIG. 5 is an explanatory diagram showing the indication and the progressive state of printing.

FIG. 5 shows the indication and the progressive state of printing.

Figure 4:
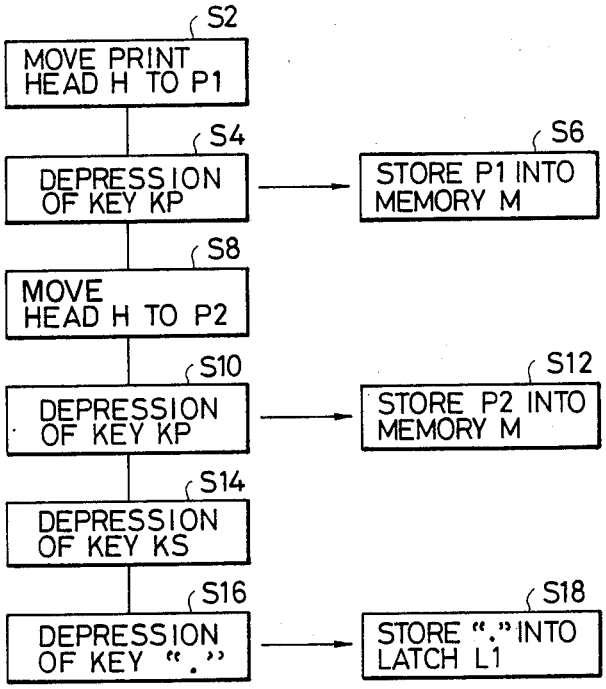
FIG. 4 is a flowchart showing a method of designation by a printer.
Figure 6A:
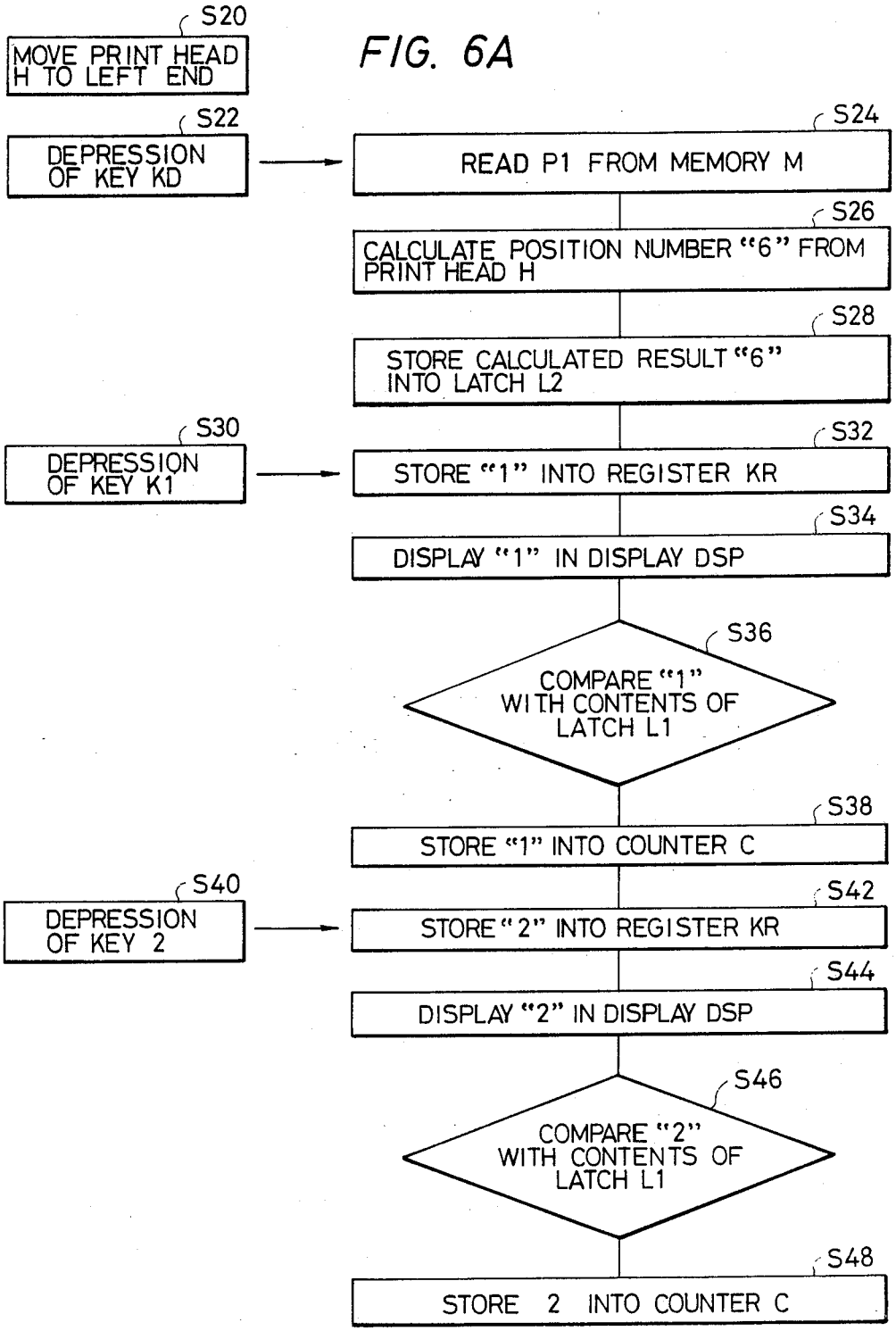
FIGS. 6A to 6C are flowcharts showing a control unit in the present embodiment.
Figure 6B:
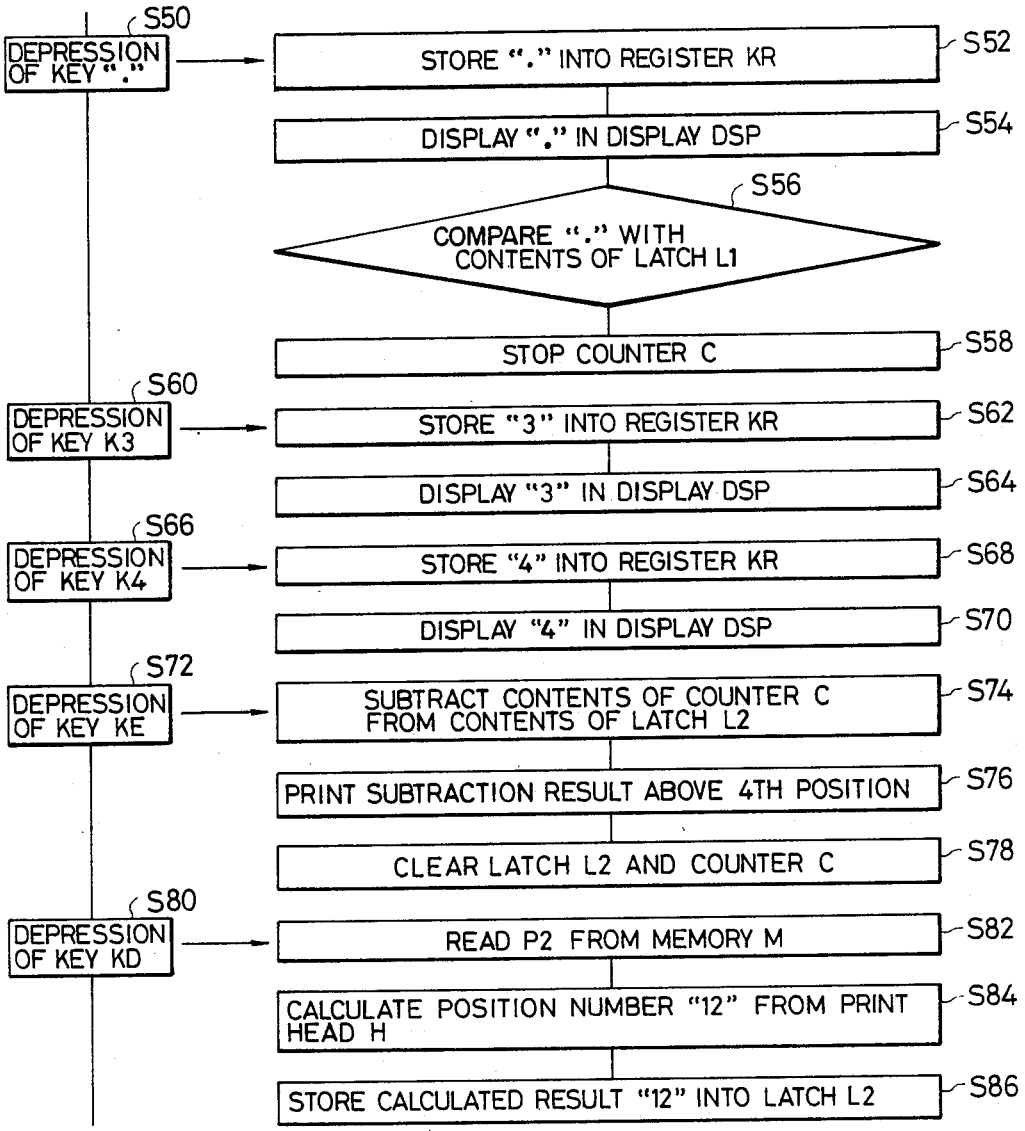
Figure 6C:
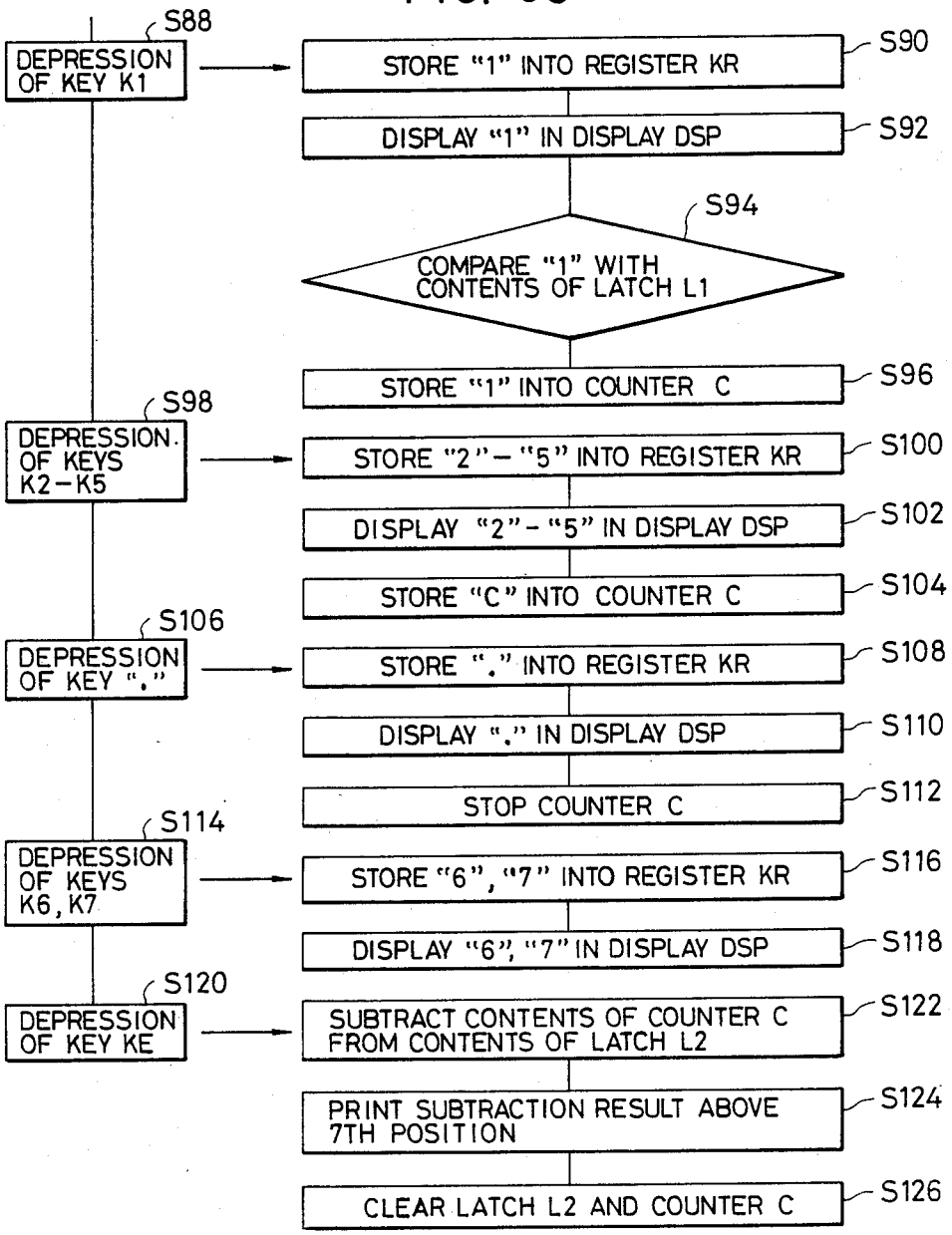

The operation of this embodiment will now be described hereinbelow in conjunction with FIGS. 5 and 6A to 6C. In this case, as shown in FIGS. 3 and 4, the designated positions P1 and P2 and the designated character "." are preset. First of all, the print head H is moved to a desired position (to the left end) (step S20). Then, the depression of the character string input start instruction key KD (step S22) allows the CPU to read out the position P1 designated adjacent the right side of the print head H from the memory M and to calculate the position number "6" from the position of the print head H to the designated position P1 (steps S24 and S26). The result calculated is stored into a latch L2 in the CPU (step S28.)

By depressing the numeric value key K1 (step S30), a numeric value "1" is stored into the register KR (step S32) and is indicated in the display DSP (step S34). At this time, the CPU compares the numeric value "1" represented by the key depressed with the contents of the latch L1 (step S36); however, since it is not the designated character, the number of "1" of depressions is stored into a counter C for storing the number of times of depression of the numeric value key (step S38).

Subsequently, by depressing the numeric value key K2 (step S40), a numeric value "2" is stored into the register KR (step S42) similarly to the depression of the numeric value key K1 and "2" is indicated in the display DSP (step S44). In addition, at this time, the count value of the counter C for counting the number of times of depression becomes "2" (steps S46 and S48).

Next, by depressing the decimal point key of "." as the designated character (step S50), a decimal point "."

is stored into the register KR (step S52) similarly to a numeric value "12", so that "12." is displayed in the display DSP (step S54) as shown in II of FIG. 5. The CPU also compares "." the contents of the latch L1 similarly to the cases of numeric values "1" and "2" (step S56). When the content of the key depressed coincides with the designated character, the CPU stops the counting operation of the counter C (step S58).

Further, by inputting numeric values "34" by use of the numeric value keys, "12.34" is displayed in the display DSP as shown in III of FIG. 5 (steps S60 to S70).

Thereafter, by depressing the instruction key KE (step S72), the CPU performs the processing to subtract the contents "2" of the counter C from a numeric value "6" stored in the latch L2 and calculates "4" as the subtracted result (step S74). The CPU moves the print head H from the present position to the fourth position and allows it to print a numeric value "1" in that position. Then, the CPU moves the head H to the right by one position, thereby printing a numeric value "2". It further moves the head to the right by one position, thereby printing the designated character "." in the designated position P1. Similarly, the print head H is moved to the right by one position at a time, so that "3" and "4" are sequentially printed (step S76). Although the contents of the counter C and latch L2 are cleared due to this (step S78), the contents "." of the latch L1 are still maintained.

Subsequently, by depressing the character string input start instruction key KD (step S80), the CPU reads the designated position P2 on the right side of the head H from the memory M (step S82) and calculates the position number "12" from the position of the print head H to the designated position P2 (step S84). The result of the calculation is stored into the latch L2 in the CPU (step S86).

By depressing the numeric key K1 (step S88), a numeric value "1" is stored into the register KR (step S90) and is displayed in the display DSP (step S92). At this time, the CPU compares "1" represented by the key depressed with the contents of the latch L1 and "1" is stored into the counter C (step S94) on the basis of the result of the comparison.

Further, when numeric values "2345" are input using the numeric value keys (step S98), the CPU performs the comparision regarding each numeric value with the contents of the latch L1 and stores the numeric values into the register KR (step S100). Then, the CPU displays those numeric values in the display DSP (step S102) and stores "5" into the counter C (step S104). By depressing the decimal point "." as the designated character (step S106), the CPU stores the decimal point "." into the register KR (step S108); displays it in the display DSP (step S110); performs the comparison processing with the contents of the latch L1; and stops the operation of the counter C on the basis of the result of the comparision (step S112). Subsequently, when numeric values "67" are input (step S114), the numeric values are indicated as shown in IV of FIG. 5 (step S116 and S118).

Now, the depression of the instruction key KE (step S120) allows the CPU to perform the processing to subtract the contents "5" of the counter C from numeric values "12" stored in the latch L2 and to calculate "7" as the subtracted result (step S122). The CPU moves the print head H from the present position (the position of "4" where the printing was previously done) to the seventh position, thereby printing a numeric value "1" in this position. Then, the CPU moves the head to the right by one position to print a numeric value "2". Similarly, numeric values "345" are printed and the designated character "." is printed in the designated position P2. Numeric values "67" are also similarly printed, so that the print as shown in V of FIG. 5 is obtained (step S124). At this time, although the contents of the latch L2 and counter C are cleared similarly to the case where "12.34" was previously printed (step S126), the contents of the latch L1 are still maintained.

By depressing some control keys thereafter, the print paper P is fed by only one line and the print head H is moved to the left end.

Subsequently, when the character string input start instruction key KD is depressed and the character information "7654.32" which is printed is input, the CPU reads out P1 from the memory M and sets it into the designated position in the same manner as in the case where "12.34" was printed and sets the characters maintained in the latch L1 into the designated characters, then the CPU executes the similar processings as the above. In addition, by depressing the instruction key KE, the CPU performs the processing to subtract the contents "4" of the counter C from the content "6" of the latch L2; calculates "2" as the subtraction result; moves the print head H from the present position to the second position; and allows the head to print "7654.32" in the manner as described above.

I claim:

1. A printer comprising:

printing means for printing a plurality of characters including a designated character;

input means for inputting the plurality of characters;

first means for storing as a designated character any of the plurality of characters;

second means for designating a particular position on a print paper at which the designated character is to be printed;

third means for storing characters to be printed as an ordered string, including the designated character within the string;

count means for counting the number of characters stored by said third means before the input thereby of the designated character;

print start-position calculation means for calculating a printing start position of a first character of said stored characters on the basis of the position designated by said second means for the designated character and the number of characters counted by said count means; and control means for controlling said printing means after the ordered string of characters to be printed are stored in said third means such that said printing means starts printing said first character of the ordered string of characters at the printing start position, the designated character thus being printed at the designated position.

2. A printer according to claim 1, wherein said particular position comprises a plurality of positions.

3. A printer according to claim 1, wherein said first, second and third means include a keyboard.

4. A printer according to claim 1, wherein said printing means includes a print head mounted for movement along the print paper.

5. A printer according to claim 1, further comprising a display unit for displaying a character.

6. A printer according to claim 1, wherein said designated character is a decimal point.

7. A printer according to claim 5, wherein said display unit has a capacity which is smaller than the maximum number of print characters on the printer paper.

8. A printer comprising:

printing means for printing a plurality of characters including a designated character;

input means for inputting the plurality of characters;

first means for storing as a designated character any of the plurality of characters;

position designating means for designating a position at which the designated character is to be printed;

storage means for storing the characters input by said input means as an ordered string;

count means for counting the number of characters input by said input means before input thereby of the designated character;

print start-position calculation means for calculating a printing start position of a first character of said stored characters based on the position designated by said position designating means for the designated character and the number of characters counted by said count means; and control means for controlling said printing means after the stored ordered string of characters to be printed are input by said input means such that said printing means starts printing said first character of the ordered string of characters stored in said storage means at the printing start position, the designated character thus being printed at the designated position.

9. A printer according to claim 8, wherein the designated character is changed by selecting means for selecting a designated character.

10. A printer according to claim 8, wherein the designated character is a decimal point.

11. A printer according to claim 8, wherein said position designating means designates a plurality of print positions in a row along which said printing means prints.

* * * * *

UNITED STATES PATENT AND TRADEMARK OFFICE

CERTIFICATE OF CORRECTION

PATENT NO. : 4,902,149

DATED : February 20, 1990

INVENTOR(S) : MATSUZAKI

It is certified that error appears in the above-identified patent and that said Letters Patent is hereby corrected as shown below: ON TITLE PAGE:

OTHER PUBLICATIONS,

Under "Adam et al," insert --6/82--.

COLUMN 5,

Line 3, "printer" should read --print--.

Signed and Sealed this

Eighth Day of September, 1992

*Attest:*

DOUGLAS B. COMER

*Attesting Officer*

*Acting Commissioner of Patents and Trademarks*